US009406488B2

(12) United States Patent
Maldonado et al.

(10) Patent No.: US 9,406,488 B2
(45) Date of Patent: Aug. 2, 2016

(54) ENHANCED PHOTOELECTRON SOURCES USING ELECTRON BOMBARDMENT

(71) Applicant: The Board of Trustees of the Leland Stanford Junior University, Palo Alto, CA (US)

(72) Inventors: Juan R. Maldonado, Menlo Park, CA (US); Yao-Te Cheng, New Taipei (TW); Piero Pianetta, Palo Alto, CA (US); R. Fabian W. Pease, Stanford, CA (US); Lambertus Hesselink, Atherton, CA (US)

(73) Assignee: The Board of Trustees of the Leland Stanford Junior University, Palo Alto, CA (US)

( * ) Notice: Subject to any disclaimer, the term of this patent is extended or adjusted under 35 U.S.C. 154(b) by 198 days.

(21) Appl. No.: 14/190,835

(22) Filed: Feb. 26, 2014

(65) Prior Publication Data

US 2014/0265828 A1 Sep. 18, 2014

Related U.S. Application Data

(60) Provisional application No. 61/790,627, filed on Mar. 15, 2013.

(51) Int. Cl.

| | |
|---|---|
| ***G09G 1/28*** | (2006.01) |
| ***H01J 29/51*** | (2006.01) |
| ***H01J 40/14*** | (2006.01) |
| ***H01J 40/18*** | (2006.01) |

(52) U.S. Cl.
CPC *H01J 40/14* (2013.01); *H01J 40/18* (2013.01)

(58) Field of Classification Search
USPC ..... 315/1–17
See application file for complete search history.

(56) References Cited

U.S. PATENT DOCUMENTS

| | | | | | |
|---|---|---|---|---|---|
| 2,888,593 | A * | 5/1959 | Anderson | H01J 31/18 | 250/214 VT |
| 3,424,932 | A * | 1/1969 | Sheldon | H01J 31/065 | 250/214 VT |
| 5,233,183 | A * | 8/1993 | Field | H01J 31/56 | 250/214 VT |
| 5,266,425 | A * | 11/1993 | Field, Jr. | G03F 9/00 | 250/214 VT |
| 6,516,048 | B2 * | 2/2003 | Mori | H01J 35/14 | 379/119 |
| 2003/0147002 | A1 * | 8/2003 | Ray | G01S 17/89 | 348/370 |
| 2005/0161703 | A1 * | 7/2005 | Costello | H01L 27/14643 | 257/183.1 |
| 2009/0206283 | A1 * | 8/2009 | Levy | H01J 1/34 | 250/504 R |
| 2014/0079188 | A1 * | 3/2014 | Hesselink | H01J 35/065 | 378/136 |

OTHER PUBLICATIONS

Liu et al., A high current density GaN/CsBr heterojunction photocathode with improved photoyield May 2007, Submitted to Applied Physics Letters.

* cited by examiner

*Primary Examiner* — Brandon S Cole
(74) *Attorney, Agent, or Firm* — Lumen Patent Firm

(57) ABSTRACT

A method of achieving heightened quantum efficiencies and extended photocathode lifetimes is provided that includes using an electron beam bombardment to activate color centers in a CsBr film of a photocathode, and using a laser source for pumping electrons in the color centers of the photocathode.

10 Claims, 2 Drawing Sheets

ENHANCED PHOTOELECTRON SOURCES USING ELECTRON BOMBARDMENT

CROSS-REFERENCE TO RELATED APPLICATIONS

This application claims priority from U.S. Provisional Patent Application 61/790,627 filed Mar. 15, 2013, which is incorporated herein by reference.

STATEMENT OF GOVERNMENT SPONSORED SUPPORT

This invention was made with Government support under grant (or contract) no. HSHQDC-12-C-00002 awarded by the Department of Homeland Security. The Government has certain rights in this invention.

FIELD OF THE INVENTION

The present invention relates generally to photoelectron sources. More particularly, the invention relates to a method to increase the photoelectron yield of thin film CsBr/metal photocathodes by activation with electron bombardment allowing efficient operation at UV and longer incident light wavelengths.

BACKGROUND OF THE INVENTION

Photoelectron emission enhancement mechanisms in metals and semiconductors have been proposed involving the creation of color centers in thin coatings of CsBr films by UV radiation damage. Here, the creation of color centers refers to energy states inside the gap that align with the Fermi level of the substrate. They are created to allow electron transitions to the conduction band with photon energy less than the gap energy. The states created with the 4.8 eV radiation have a relatively narrow width and have an energy of about 3.8 eV inside the gap. In addition, other proposed possible color center mechanisms allow Br atoms to move to the CsBr vacuum surface. It is postulated that Br neutral atoms are expelled to the vacuum leaving a charged Cs layer, which lowers the work function of the photocathode structure. This motion of Br atoms away from the CsBr film if it occurs may be consider as ablation limiting the lifetime of the photocathode. However, only a monolayer of atoms is required to lower the work function of the CsBr/vacuum interface, and the CsBr films may be hundreds of monolayers thick. Similar atomic motion may occur to form a Cs layer at the CsBr/substrate interface lowering the work function to electrons directly emitted by the substrate metal or other material and transmitted by the CsBr film. Typical operation of a CsBr/metal photocathode shows an initial increase in the photoelectron yield reaching a maximum and then decays to reach a steady state value. This behavior is attributed to the formation of a Cs layer on the vacuum CsBr interface surface reaching equilibrium with contaminants (mainly C and O) in the vacuum system. Successful operation for hundreds of hours with a laser spot of about 1.5 microns has been obtained at a vacuum pressure of $1\times10^{-9}$ torr. Operation for thousands of hours is possible by locating the laser spot on fresh unexposed areas of the photocathode in a sequential manner.

It has been known for some time that alkali halides develop color centers when subjected to UV or low energy e-beam irradiation. For the UV case, it was discovered that CsBr films (1-25 nm thick) deposited on metal or semiconductor layers can increase the photoelectron yield of the underlying substrate by a large factor when illuminated with UV radiation with a photon energy less than the CsBr bandgap of about 7 eV. The use of CsBr based photoelectron sources for electron beam lithography and related applications has been hampered by the need for bulky and expensive UV lasers to provide the short wavelengths (e.g. 257 nm) necessary to generate sufficiently energetic photons to bring about useful current densities, where "activation" was done by a UV laser having 257 nm wavelength to introduce color center, with energy states inside the band gap.

What is needed is a device and method of activating color centers that obtains photoelectron emission with longer wavelengths and can achieve heightened quantum efficiencies and extended photocathode lifetimes.

SUMMARY OF THE INVENTION

To address the needs in the art, A method of achieving heightened quantum efficiencies and extended photocathode lifetimes is provided that includes using an electron beam bombardment to activate color centers inside of a photocathode, and using a light source for pumping electrons in the color centers of the photocathode.

According to one aspect of the invention, the light source can include a laser, LED, or incandescent light bulb. Here, the laser source includes a 405 nm laser source.

In another aspect of the invention, the photocathode can include a CsBr-on-metal or semiconductor, a CsBr film, and a CsBr-on-ITO film. Here, the CsBr film can include a doped CsBr film, where the doped CsBr film is capable of having a color center that is different than the pure CsBr color center. In another aspect, the color centers are created with energy up to the material energy gap, where the CsBr has an energy bandgap of ~7.3 eV.

According to a further aspect of the invention, the color centers are created with energy levels up to the material band gap energy above the valence band maximum.

In one aspect of the invention, the color centers are formed in a material with an energy gap of about 7 eV. Other materials and alkali halide materials with different energy gaps can be utilized.

According to another aspect of the invention, the electron beam bombardment is repeated during operation of the photocathode, where the repeated electron beam bombardment is directed to a previously e-beam exposed region of the photocathode.

In yet another aspect of the invention, the electron beam source comprises a pulsed or a CW electron beam source.

DETAILED DESCRIPTION

According to one embodiment, the current invention uses electron beam bombardment to create and activate color centers. Here, the electron beam activated color centers provide more than 10 times higher quantum efficiency than the UV activated color centers with photoelectron emission operated by a 257 nm UV laser. According to one embodiment, the photoelectron emission is operated with a 405 nm laser for pumping electrons, which results in more than a factor of 1000 improvement in quantum efficiency with the electron beam activated color centers than, and with more than a factor of 500 improvement in the photocathode lifetime. In one aspect, the activated color centers can include similar or different color centers, or intra-band states, from UV activated color centers.

The advantage for this electron beam bombardment activation of color centers for photocathodes is to create paths to use lower photon energy to operate photoelectron emission as an electron beam source. The current invention uses less expensive and smaller lasers to obtain better quantum efficiency than UV lasers for photoelectron emission operation using the same photocathode. This invention may be applied to other photocathode materials.

Figure 1:
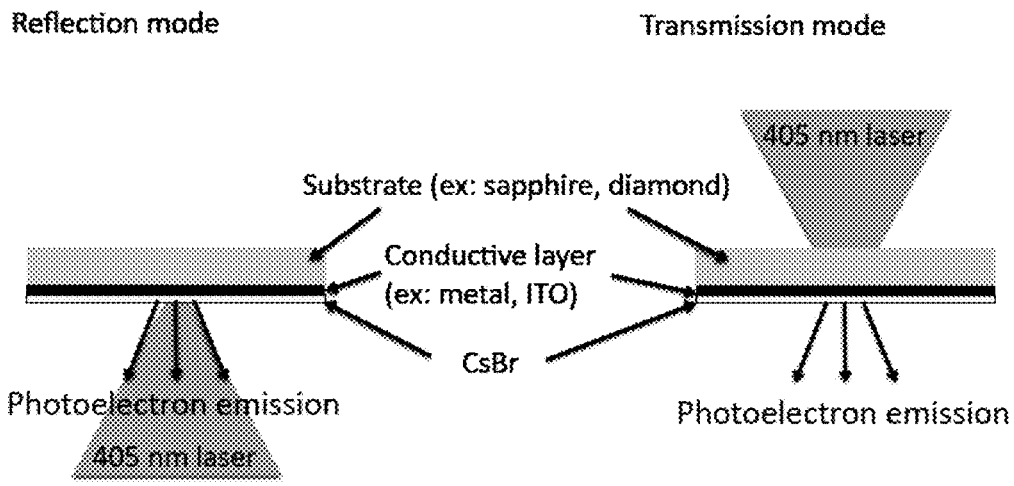
FIG. 1 shows a schematic drawing of compact laser operating at 405 nm to illuminate a CsBr-on-metal photocathode and so generate photoelectrons with a current density exceeding 200 A/cm$^2$, where the photoelectron may operate in both reflection mode and transmission mode, according to one embodiment of the invention.

One embodiment of the current invention, as shown in FIG. 1, includes the use of a very compact laser operating at 405 nm to illuminate a CsBr-on-metal photocathode and so generate photoelectrons with a current density exceeding 200 $A/cm^2$, which is more than adequate for many applications including electron beam lithography. The photocathode can include a CsBr-on-metal or semiconductor, a CsBr film, and a CsBr-on-ITO film. Here, the CsBr film can include a doped CsBr film, where the doped CsBr film is capable of having a color center that is different than the CsBr color center. In another aspect, the color centers are created with energy up to the material energy gap, where the CsBr has an energy band-gap of ~7.3 eV. According to a further aspect of the invention, the color centers are created with energy levels up to the material band gap energy above the valence band maximum.

A key feature of one embodiment is to bombard the CsBr film, as a pre-treatment, with low energy electrons at low current densities (as might be generated by a simple W-filament). These electrons generate the necessary in-gap states to allow excitation at such long wavelengths and also Br desorption may occur to expose a Cs monolayer at the CsBr vacuum interface lowering the work function. The optimum energies for the bombarding electrons for different thicknesses of CsBr films to maximize photoelectron yield and preserve lifetime due to ablation are used. The current invention provides for the first time photoelectron emission enhancement at 405 nm and other shorter wavelengths from color centers induced in CsBr films by low energy e-beam radiation.

In one embodiment of this invention, the 4.8 eV (257 nm) UV radiation is replaced with a relatively low energy (10-2000 eV) electron energy to activate the CsBr film before being subjected to long wavelength photon exposure. The electrons penetrate thru the film depositing their energy to create color centers in the CsBr films.

Figure 2:
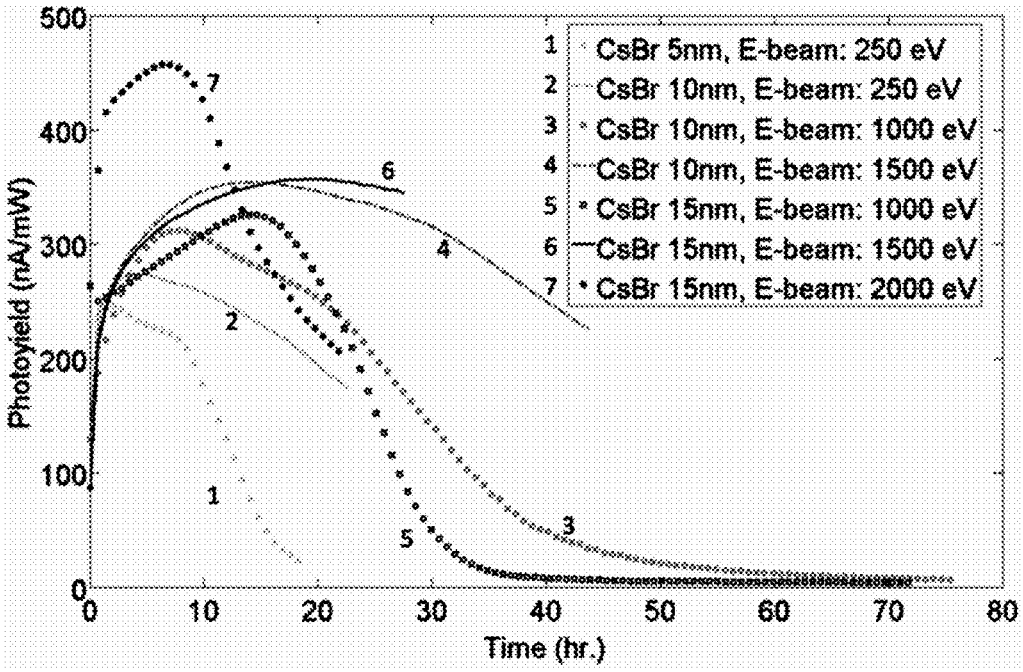
FIG. 2 shows exemplary experimental results according to one embodiment of the current invention.

Some exemplary experimental results are shown in the FIG. 2, which indicate that continuous operation with a 405 nm solid-state diode laser is capable of providing a photoelectron yield higher than the one obtained with only UV 257 nm activation without e-beam previous irradiation.

In one aspect, the energy states lying inside the ~7 eV gap are formed to allow photoelectron emission with a relative long wavelength from a 405 nm solid state laser. According to one embodiment, color centers are created with energy levels within the band gap of the material, for example the CsBr band gap energy is ~7.3 eV.

As shown in the FIG. 2, the operation at 405 nm with relatively high photoelectron yield can be sustained for many hours after e-beam exposure. It is also shown in FIG. 2 that in contrast to the photoelectron yield behavior with UV activation described below, the photoelectron yield increases initially reaching a maximum higher than the maximum obtained with only UV activation and operated at 257 nm, and then continuously decreases relatively fast after a few hours. However, no equilibrium condition with reasonable high photoelectron yield is observed. This can be attributed to a few reasons: 1. the lack of Cs replenishment by the 405 nm radiation, 2. due to the contamination of the CsBr surface, 3. photo-bleaching of the color center states, and 4. thermal-bleaching of the color center states. To sustain the high photoelectron emission, repeated electron beam activation periods are required as mentioned below to maintain a relative high photoelectron yield. It appears that for a 15 nm thick CsBr film, operation with 1.5 KeV energy electrons is advantageous. This behavior is in agreement with estimates of 1.5 KeV electron range in CsBr films of about 12 nm. Increasing the electron energy to 2 KeV initially increases the photoelectron yield, which is likely due to the lack of color centers closer (say<15 nm) to the CsBr surface, where the photoelectron emission takes place. This is because with higher energy, e-beam penetrates deeper in the CsBr/metal film. In this particular embodiment of the invention, the CsBr photocathode may be periodically exposed to low energy incident electrons for a relatively short time to maintain a constant photoelectron yield under long wavelength photon excitation (ie. 405 nm). Other activation conditions are possible including doping the CsBr films. Different photoemitter materials, such as GaN substrates coated with CsBr, rare earth element dopants, changing the laser wavelength or changing the target temperature are possible solutions.

According to another aspect of the invention, the electron beam bombardment is repeated during operation of the photocathode, where the repeated electron beam bombardment is directed to a previously e-beam exposed region of the photocathode. Photoelectron yield in the e-beam exposed region reduces during operation of the photocathode or just for a period of time may be caused by surface contamination, photo-bleaching, or thermal-bleaching of the color center states. E-beam exposure on a previously exposed area with low photoelectron yield reduces the contamination of the area, replenishes the color centers and increases the photoelectron yield. E-beam exposure also can be made on a previously e-beam unexposed area to start the enhanced photoemission process in the area.

Figure 3:
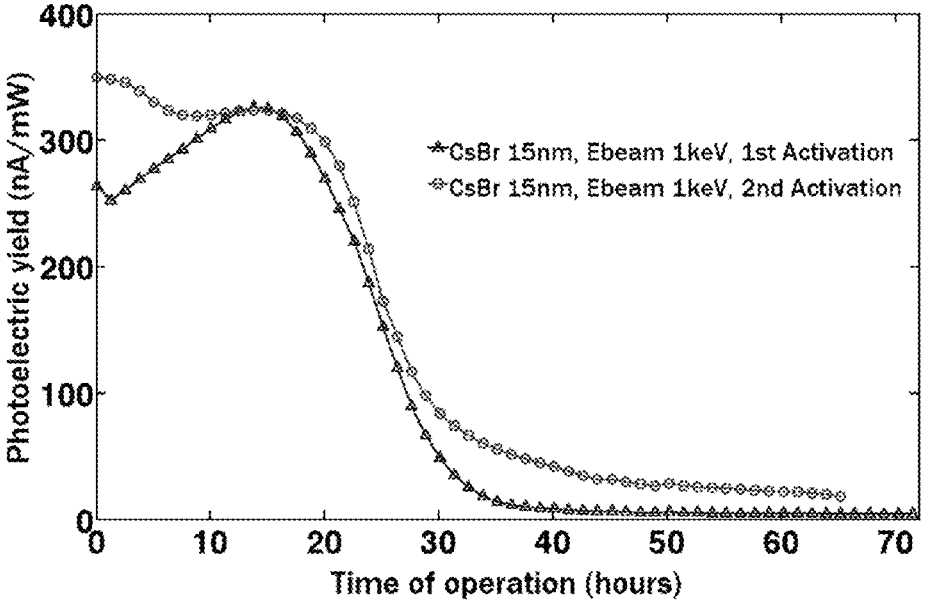
FIG. 3 shows a graph of the repeatability of e-beam activation followed by photoelectron emission, according to one embodiment of the invention.

FIG. 3 shows a graph of the repeatability of e-beam activation followed by photoelectron emission, according to one embodiment of the invention.

Figure 4:
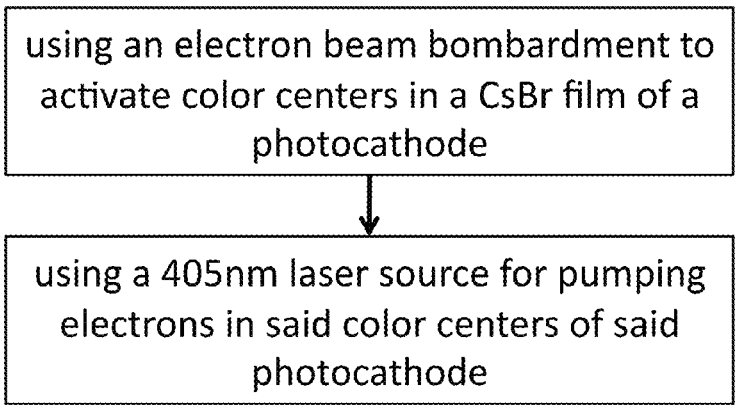
FIG. 4 shows a flow diagram of one embodiment of the current invention.

FIG. 4 shows a flow diagram of one embodiment of the current invention.

The invention makes possible the high efficiency operation of photocathode electron sources with relatively long wavelength lasers. Some variations include the photocathode material can be changed to CsI, or other alkali material combination. Other electron beam energy, CsBr thickness or substrates such as GaN may be utilized.

Applications of the current invention can include a photoelectron source for creating an X-ray source that can be pulsed and attain shapes conducive to compressive imaging. Additionally, a shaped X-ray source produces partially coherent radiation useful for medical applications and industrial inspection. The shaped optical beam used for generating electrons can be shaped in almost any form, including that of a grating now used for rendering an incoherent source into a partially coherent source for use in X-ray Differential Phase Contrast (DPC) imaging applications for medical and industrial inspection and imaging.

A further application includes the CsBr photoelectron source disposed to provide new methods for generating pulsed X-rays by pulsing the excitation optical source. This will allow pulsed X-ray and electron imaging for applications in mass spectroscopy, medical diagnosis imaging, and biological studies.

The relatively small size and low voltage requirements of the current invention for powering the electron source enable portable applications.

The present invention has now been described in accordance with several exemplary embodiments, which are intended to be illustrative in all aspects, rather than restrictive. Thus, the present invention is capable of many variations in detailed implementation, which may be derived from the description contained herein by a person of ordinary skill in the art. For example the photocathodes activated by electron beams may show an increase in the energy spread of the emitted photo electrons. For example, the invention can include the use of diamondoid films deposited on the substrates under the CsBr films to reduce the energy spread if required.

All such variations are considered to be within the scope and spirit of the present invention as defined by the following claims and their legal equivalents.

What is claimed:

1. A method of achieving heightened quantum efficiencies and extended photocathode lifetimes, comprising:

a. using an electron beam bombardment to activate color centers in a photocathode, wherein said photocathode comprises a substrate layer, a conductive layer, an alkali halide film disposed on said conductive layer or a semiconductor film disposed on said conductive layer, wherein said electron beam bombardment bombards said alkali halide film or said semiconductor film as a pre-treatment, wherein said electron bombardment generates in-gap color center states or intra-band states in said alkali halide film or said semiconductor film to enable photon excitation in a bandgap of said alkali halide film or said semiconductor film, wherein said color centers comprise energy levels within a band gap of said alkali halide film or said semiconductor film of said photocathode, wherein said electron beam is disposed to directly bombard said photocathode with electrons; and b. using photons from a separate light source for pumping electrons in said color centers of said photocathode, wherein said photon excitation in said bandgap of said alkali halide film or said semiconductor film is provided at a different time from said electron bombardment, wherein said pumped electrons improve a quantum efficiency of said photocathode, wherein said pumped electrons improve the lifetime of said photocathode.

2. The method according to claim 1, wherein said light source is selected from the group consisting of laser, LED, and incandescent light bulb.

3. The method according to claim 2, wherein said laser comprises a 405 nm laser source.

4. The method according to claim 1, wherein said photocathode is selected from the group consisting of a doped alkali halide-on-metal, a doped alkali halide-on-semiconductor, a doped alkali halide film, a doped alkali halide-on-ITO film, a semiconductor-on-metal, a semiconductor-on-ITO film, a doped semiconductor-on-metal, and a doped semiconductor-on-ITO film.

5. The method according to claim 4, wherein said alkali halide film is selected from the group consisting of a CsBr film, a CsI film, a GaN substrate coated with CsBr, a doped CsBr film and a doped CsI film, wherein said doped CsBr film is capable of having a color center that is different than said CsBr color center, wherein said doped CsI film is capable of having a color center that is different than said CsI color center.

6. The method according to claim 4, wherein said color centers are created with energy levels up to the material band gap energy above the valence band maximum, wherein said CsBr has an energy bandgap of ~7.3 eV.

7. The method according to claim 1, wherein said color centers are created with energy levels up to the material band gap energy above the valence band maximum.

8. The method according to claim 1, wherein said electron beam bombardment is repeated during operation of said photocathode, wherein said repeated electron beam bombardment is directed to a previously exposed or unexposed region of said photocathode.

9. The method according to claim 1, wherein said electron beam source comprises a pulsed or a CW electron beam source.

10. The method according to claim 1, wherein said electron bombardment generates desorption in said alkali halide film to expose a monolayer at the alkali halide surface to reduce a work function of said alkali halide film.

* * * * *